US008695893B2

(12) United States Patent
Wang

(10) Patent No.: US 8,695,893 B2
(45) Date of Patent: Apr. 15, 2014

(54) PERCUSSIVE SPRINKLER WITH ACCURATE OUTFLOW ANGLE ADJUSTMENT FUNCTIONS

(76) Inventor: Cheng-An Wang, Chang Hua Hsien (TW)

( * ) Notice: Subject to any disclaimer, the term of this patent is extended or adjusted under 35 U.S.C. 154(b) by 379 days.

(21) Appl. No.: 13/186,710

(22) Filed: Jul. 20, 2011

(65) Prior Publication Data

US 2013/0020407 A1 Jan. 24, 2013

(51) Int. Cl.
*B05B 3/02* (2006.01)
*B05B 3/14* (2006.01)

(52) U.S. Cl.
USPC ..... 239/230; 239/232; 239/233

(58) Field of Classification Search
CPC .... B05B 3/0472; B05B 15/066; B05B 3/0454
USPC ..... 239/222.17, 230, 232, 233
See application file for complete search history.

(56) References Cited

U.S. PATENT DOCUMENTS 3,033,469 A * 5/1962 Green ..... 239/230
4,531,674 A * 7/1985 Drechsel ..... 239/230
7,841,545 B2 * 11/2010 Wang ..... 239/230

* cited by examiner

*Primary Examiner* — Dinh Q Nguyen
(74) *Attorney, Agent, or Firm* — Egbert Law Offices, PLLC

(57) ABSTRACT

A percussive sprinkler with accurate outflow angle adjustment functions includes a main body, a percussive diversion frame and swaying portion. Said swaying portion is formed between the main body and assembly portion or between the sprinkler head and assembly portion. An outflow angle regulator is set correspondingly to the swaying portion. Said outflow angle regulator comprises of an angle division and locating frame, which is provided with an arched surface and tooth flange set along the arched surface. A driving rod is provided with a tooth flanged portion that can be meshed with the tooth flange of the angle division and locating frame. A locating portion is used to limit the driving rod and make it in a rotatable state. The rotary shift of the sprinkler head can be located segmentally, enabling users to adjust accurately the outflow angle of the sprinkler head.

6 Claims, 6 Drawing Sheets

PERCUSSIVE SPRINKLER WITH ACCURATE OUTFLOW ANGLE ADJUSTMENT FUNCTIONS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a percussive sprinkler, and more particularly to an innovative one which is designed for accurate adjustment of the outflow angle.

2. Description of Related Art Including Information Disclosed Under 37 CFR 1.97 and 37 CFR 1.98

Percussive sprinklers are extensively used for irrigation in gardening applications, since circulating or reciprocating water sprinkling of the percussive sprinklers can be realized in an annular zone.

A percussive sprinkler that allows users to change the spraying distance has been developed in response to diversified sprinkling and irrigation demands. In the present invention, the inventor has improved a percussive sprinkler with adjustable outflow angle. Given the fact that a variety of percussive sprinklers with adjustable outflow angle make it difficult to adjust accurately the outflow angle, there is still a big room for improvement of the existing percussive sprinkler.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The enhanced efficacy of the present invention is as follows:

Based on the unique design of the present invention wherein the outflow angle regulator is set on the percussive sprinkler, and also comprises of: an angle division and locating frame, a driving rod and locating portion. The tooth flange of the angle division and locating frame is meshed with the tooth flanged portion of the driving rod, so the rotary shift of the sprinkler head can be located segmentally, enabling users to adjust accurately, conveniently and flexibly the outflow angle of the sprinkler head with better applicability.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
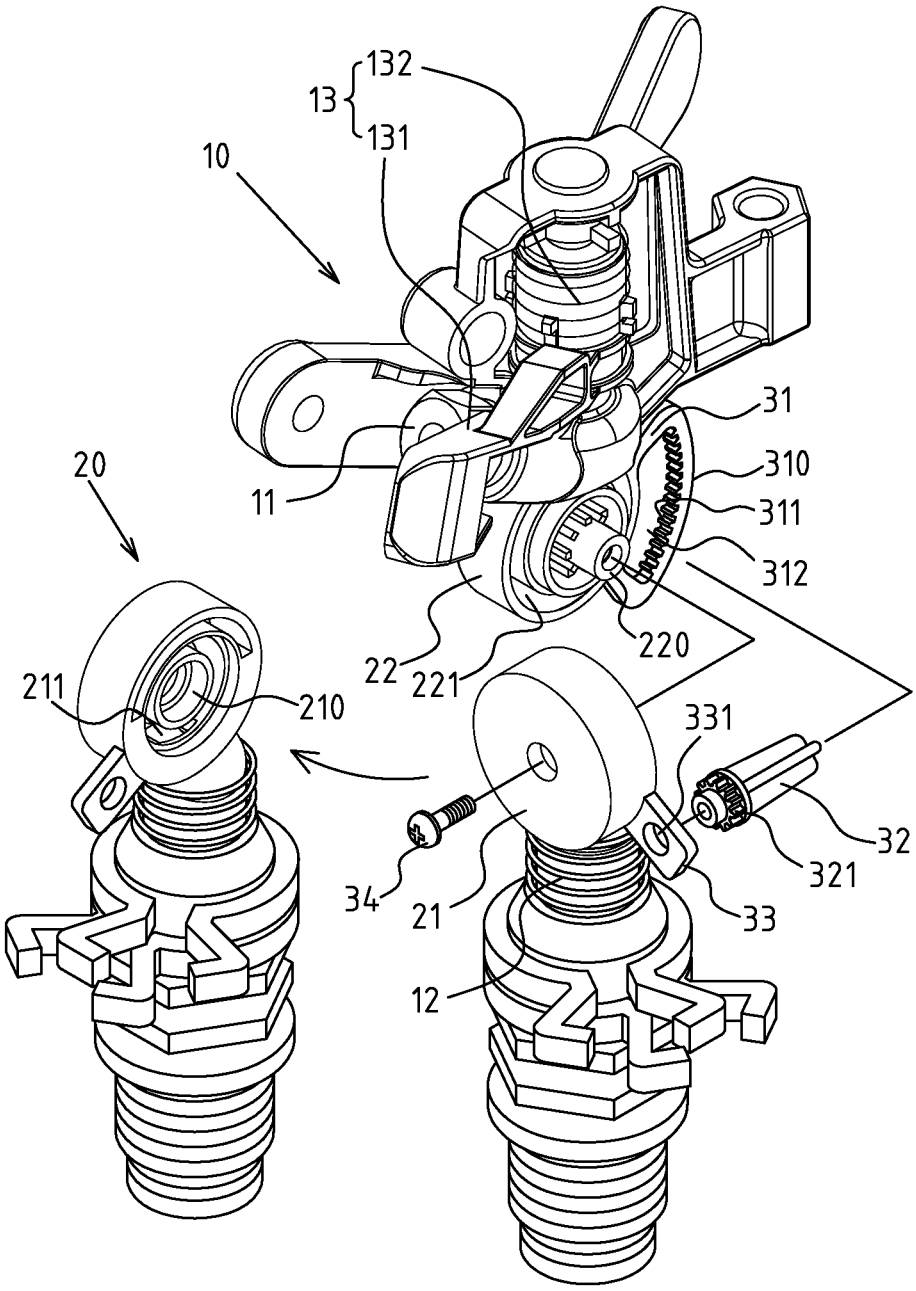
FIG. 1 is an exploded perspective view of the preferred embodiment of the present invention.
Figure 2:
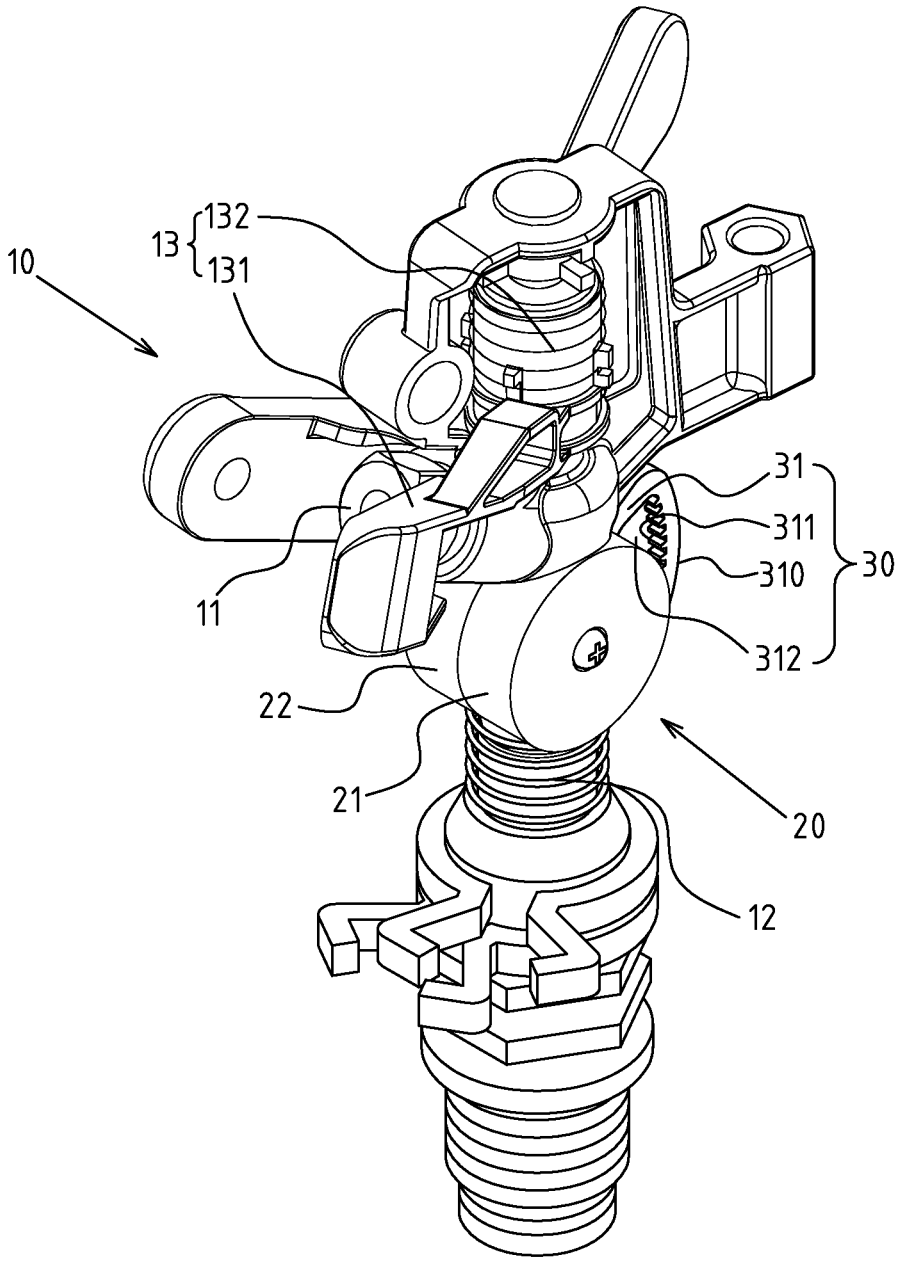
FIG. 2 is an assembled perspective view of the preferred embodiment of the present invention.
Figure 3:
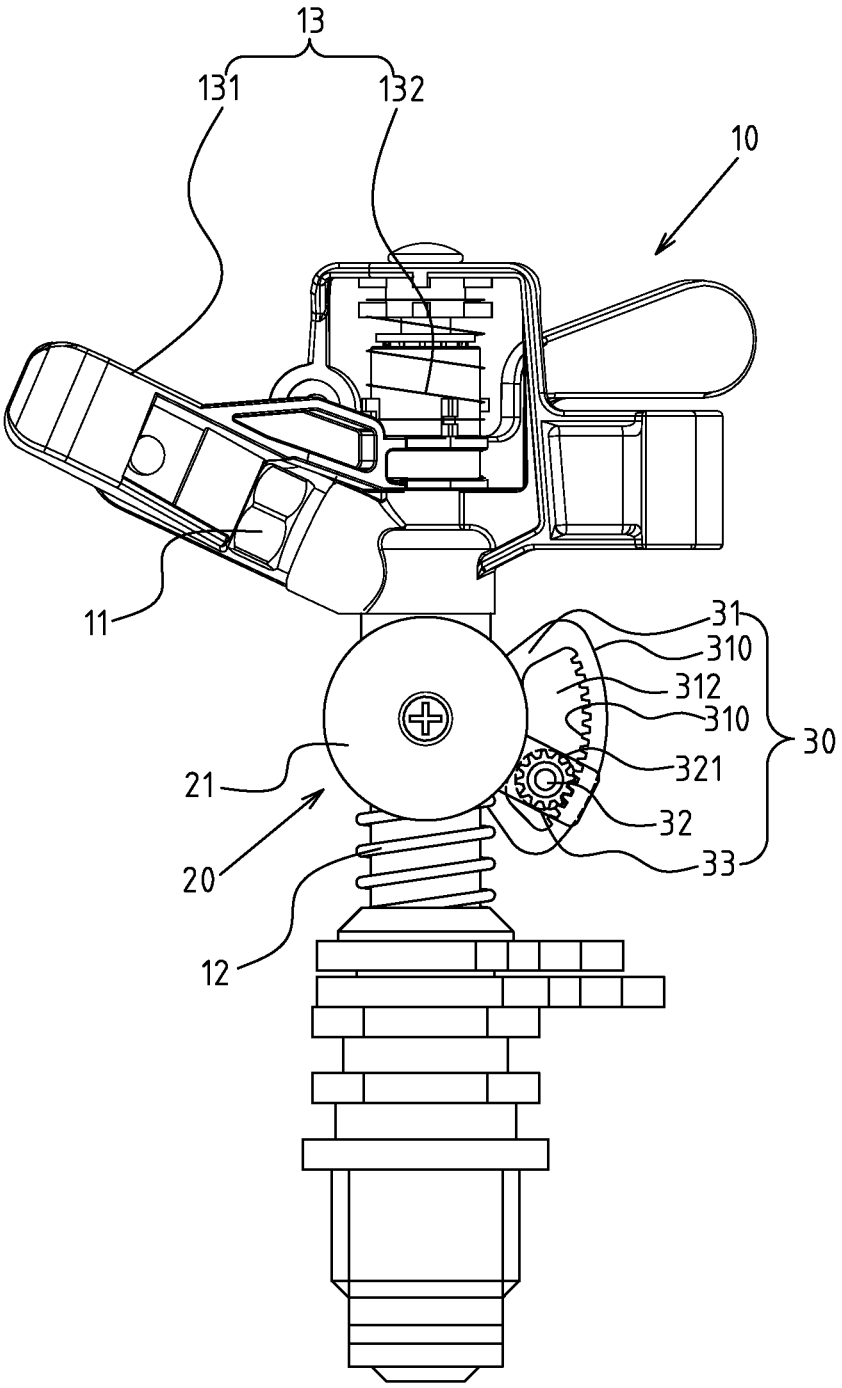
FIG. 3 is an assembled plan view of the preferred embodiment of the present invention.

FIGS. 1-4 depict preferred embodiments of a percussive sprinkler of the present invention with accurate outflow angle adjustment function, which, however, are provided for only explanatory objective for patent claims. Said percussive sprinkler with accurate outflow angle adjustment function comprises a main body 10, onto which a sprinkler head 11 is protruded forwards. An assembly portion 12 is arranged on a preset location of the main body 10. A parabolic water column is formed when water stream is sprayed from the sprinkler head 11.

A percussive diversion frame 13 is assembled flexibly onto a preset location of the main body 10. A hydraulic pusher 131 and a torsional spring 132 are arranged at one side of the percussive diversion frame 13. The hydraulic pusher 131 is located correspondingly with a spacing to the front end of the sprinkler head 11 of the main body 10.

A swaying portion 20 is formed between the main body 10 and assembly portion 12 or between the sprinkler head 11 and assembly portion 12.

An outflow angle regulator 30 is arranged correspondingly to the swaying portion 20. Said outflow angle regulator 30 comprising an angle division and locating frame 31, which is provided with an arched surface 310 and tooth flange 311 along the arched surface 310. The arched surface 310 of the angle division and locating frame 31 is designed into an arched pattern. Moreover, the angle division and locating frame 31 is provided with a hollow portion 312, which is located correspondingly to the arched surface 310, such that the tooth flange 311 is formed internally onto the arched surface 310. A driving rod 32 is provided with a tooth flanged portion 321 that can be meshed with the tooth flange 311 of the angle division and locating frame 31. The tooth flanged portion 321 of the driving rod 32 is set annularly onto one end of the driving rod 32. A locating portion 33 is used to limit the driving rod 32 and make it in a rotatable state.

The tooth flange 311 of the angle division and locating frame 31 for the outflow angle regulator 30 is meshed with the tooth flanged portion 321 of the driving rod 32, so the rotary shift of the sprinkler head 11 can be located segmentally, enabling users to adjust accurately the outflow angle of the sprinkler head 11.

Referring to FIGS. 1-4, showing a preferred embodiment of the present invention, when the swaying portion 20 is formed between the main body 10 and assembly portion 12, it comprises of a permanent seat 21 set onto the assembly portion 12 and a rotating seat 22 set onto the main body 10. Moreover, the permanent seat 21 and the rotating seat 22 are pivoted together, such that the main body 10 is kept in a swinging state, and the sprinkler head 11 allows to adjust the outflow angle in tune with the varying rotation or shift angle of the swaying portion 20. Of which, the angle division and locating frame 31 is linked to the rear end of the rotating seat 22 of the main body 10, while the locating portion 33 is linked to the rear end of the permanent seat 21 of the assembly portion 12, and a punch hole 331 is set for transverse insertion and locating of the driving rod 32. The rotating seat 22 is provided with a shaft lever 220 and a circumferential flow channel 221, and the permanent seat 21 is provided with a shaft hole 210 for the shaft lever 220, allowing for fixation via bolt 34. The permanent seat 21 is also provided with a water inlet 211.

Based upon above-specified structural design, the percussive sprinkler of the present invention is operated as follows: the assembly portion 12 of said percussive sprinkler is assembled onto an inlet pipe. When the water stream is conveyed to the main body 10 through the assembly portion 12, water is fed into the circumferential flow channel 221 of the rotating seat 22 via water inlet 211 of the permanent seat 21, and then sprayed from the sprinkler head 11 of the main body 10. In such case, water flow may impinge on the hydraulic pusher 131 of the percussive diversion frame 13, so that the hydraulic pusher 131 sways outwards, and the torsional spring 132 of the percussive diversion frame 13 generates a torsional restoring force, enabling rotary resetting of the hydraulic pusher 131. Meanwhile, sprinkling and circular motion are generated simultaneously to ensure rotary sprinkling of the percussive sprinkler.

Figure 4:
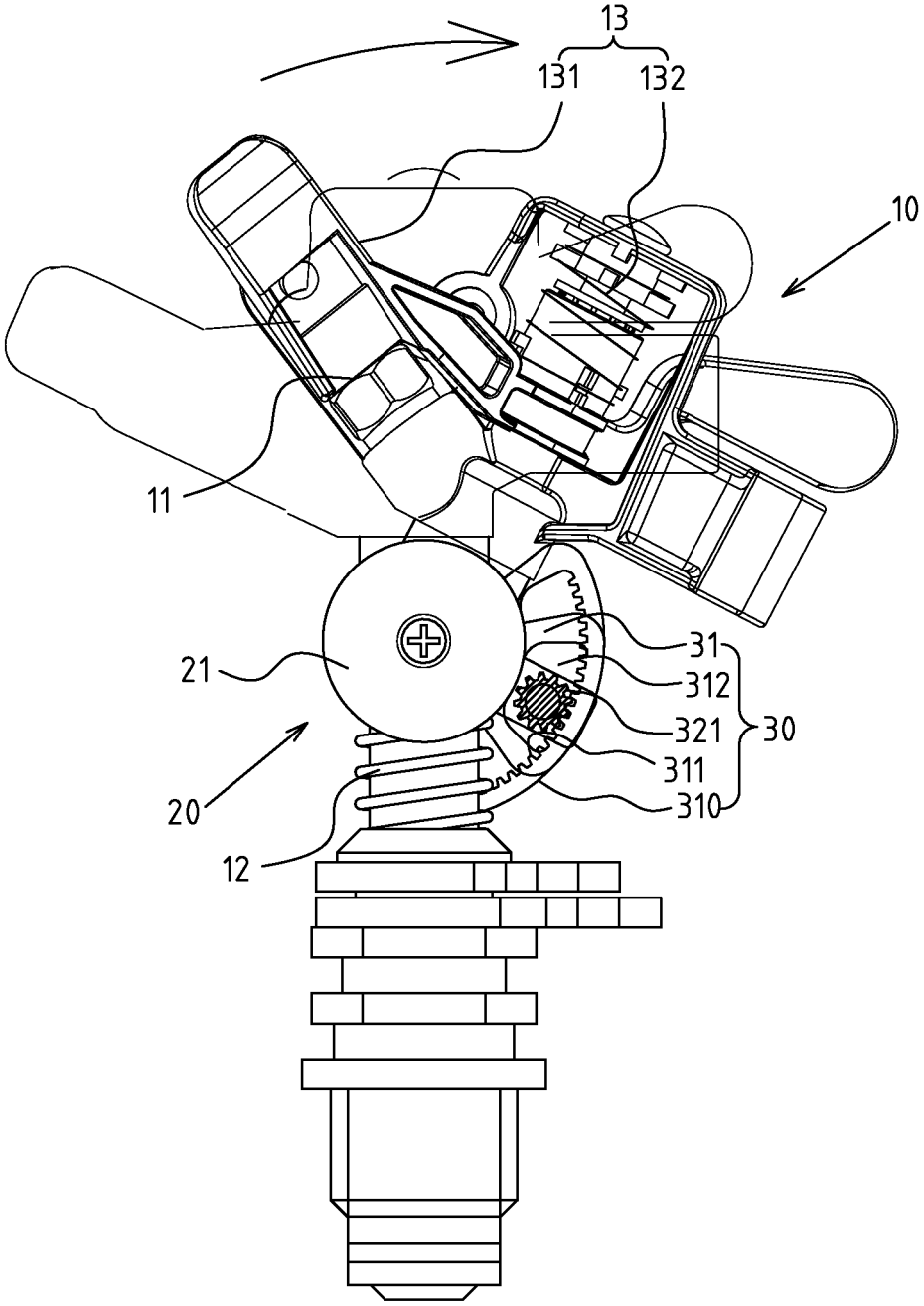
FIG. 4 is a schematic view of the preferred embodiment of the present invention, illustrating operation thereof.

The core design of the percussive sprinkler of the present invention lies in that, an outflow angle regulator 30 is set correspondingly to said swaying portion 20. Referring to FIG. 4, when the user is intended to adjust the outflow angle of the sprinkler head 11, the angle division and locating frame 31 may swing in tune with the main body 10, such that the tooth flange 311 of the angle division and locating frame 31 is meshed with the tooth flanged portion 321 of the driving rod 32 for desired angle division and locating, enabling users to adjust accurately the outflow angle of the sprinkler head 11.

Figure 5:
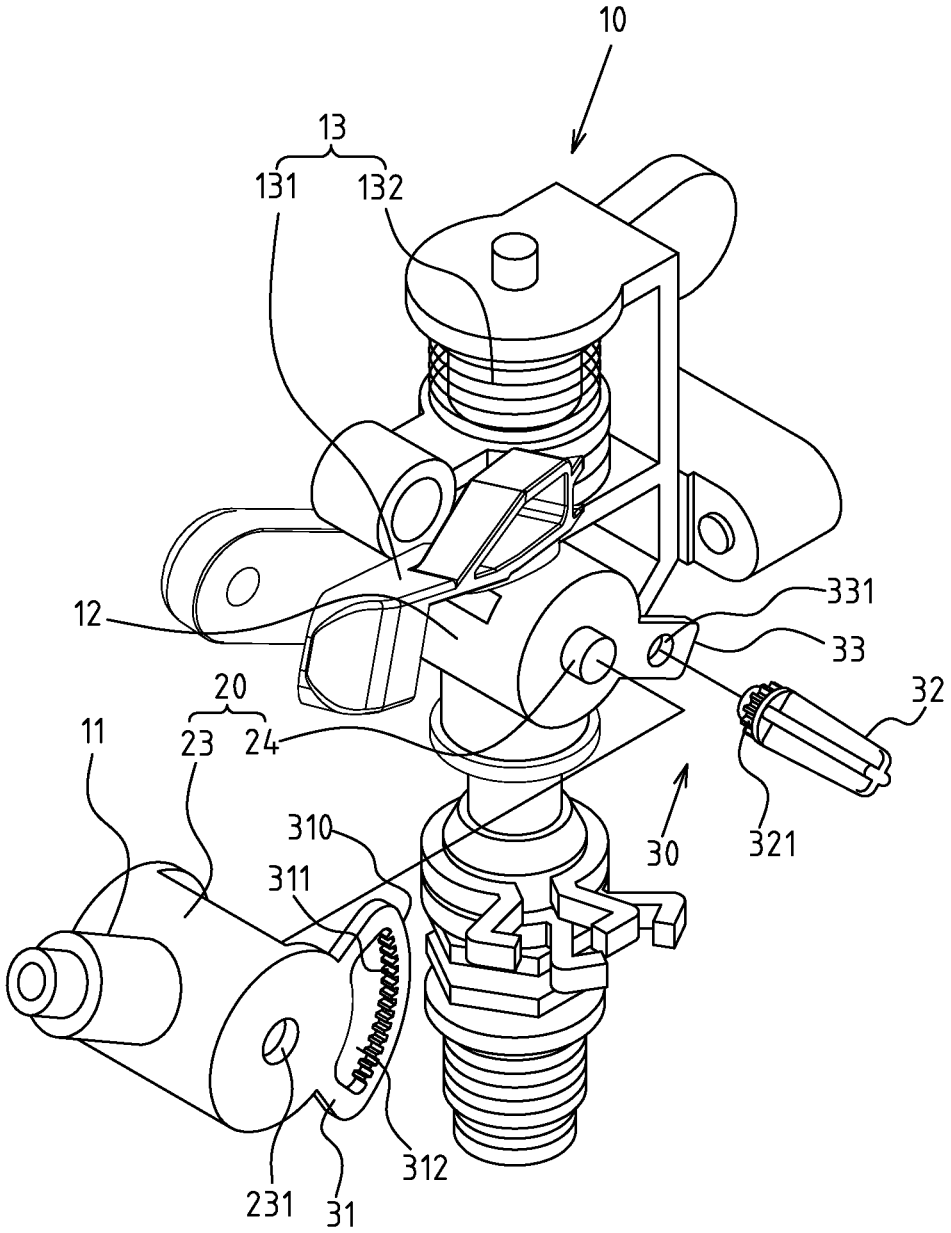
FIG. 5 is an exploded perspective view of another preferred embodiment of the present invention.
Figure 6:
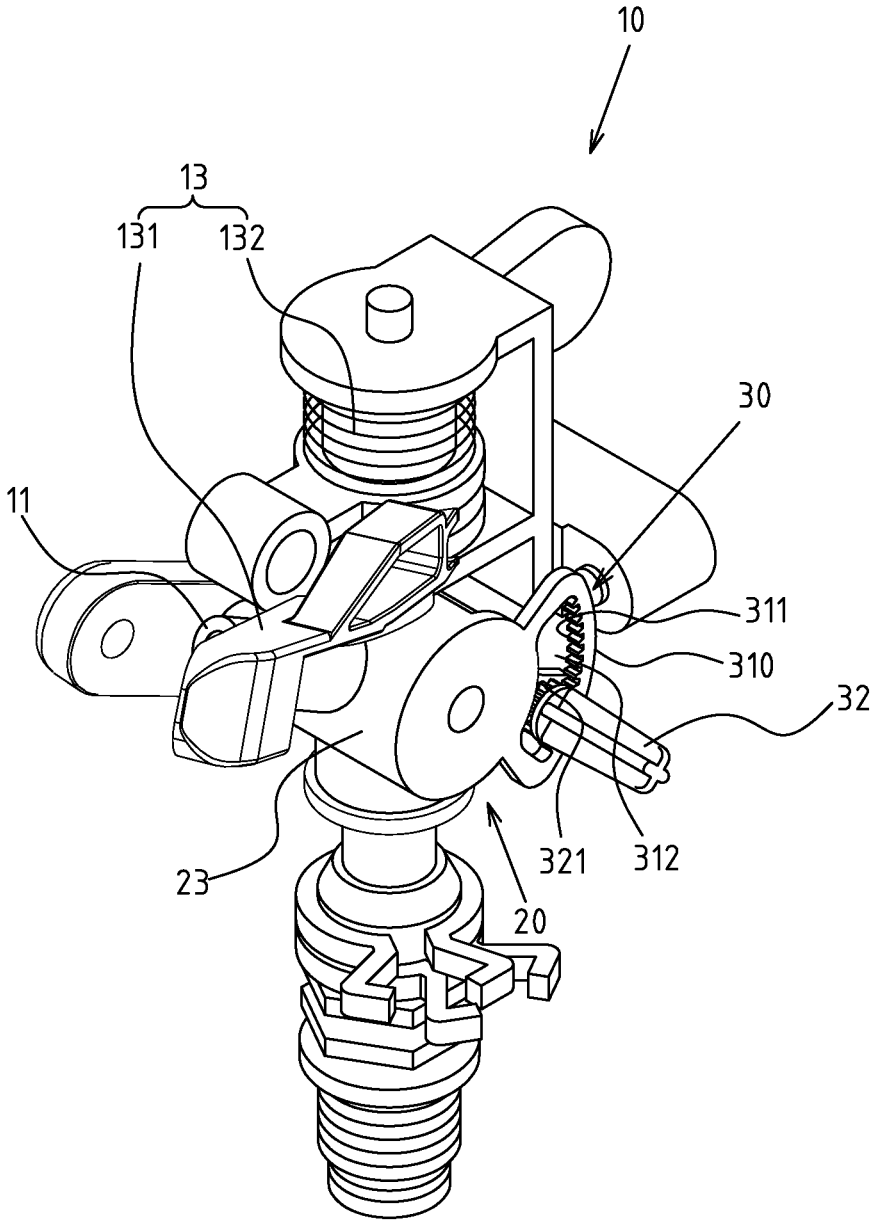
FIG. 6 is an assembled perspective view of another preferred embodiment of the present invention.

Referring also to FIGS. 5 and 6, another preferred embodiment of the present invention, when said swaying portion 20 is formed between the sprinkler head 11 and assembly portion 12, it comprises of a rotating seat 23 and two locating bulges 24 set at both sides of the assembly portion 12. Said sprinkler head 11 is set on the rotating seat 23, which is provided with a locating portion 231. The locating portion 231 of the rotating seat 23 is locked onto the locating bulge 24 to enable free swinging of the sprinkler head 11. Of which the angle division and locating frame 31 is linked to the rear end at one side of the rotating seat 23, while the locating portion 33 is linked correspondingly to the main body 10, and a punch hole 331 is set for transverse insertion and locating of the driving rod 32.

I claim:

1. A percussive sprinkler with accurate outflow angle adjustment functions, comprising:

a main body, onto which a sprinkler head is protruded forwards; and an assembly portion is arranged on a preset location of the main body;

a percussive diversion frame, assembled flexibly onto a preset location of the main body; a hydraulic pusher and a torsional spring are arranged at one side of the percussive diversion frame; the hydraulic pusher is located correspondingly with a spacing to the front end of the sprinkler head of the main body;

a swaying portion, formed between the main body and assembly portion or between the sprinkler head and assembly portion;

an outflow angle regulator, arranged correspondingly to the swaying portion; said outflow angle regulator comprising of:

an angle division and locating frame, which is provided with an arched surface and tooth flange set along the arched surface;

a driving rod, which is provided with a tooth flanged portion that can be meshed with the tooth flange of the angle division and locating frame;

a locating portion, used to limit the driving rod and make it in a rotatable state;

the tooth flange of the angle division and locating frame for the outflow angle regulator is meshed with the tooth flanged portion of the driving rod, so the rotary shift of the sprinkler head can be located segmentally, enabling users to adjust accurately the outflow angle of the sprinkler head.

2. The structure defined in claim 1, wherein said swaying portion formed between the main body and assembly portion comprises of a permanent seat set onto the assembly portion and a rotating seat set onto the main body; moreover, the permanent seat and the rotating seat are pivoted together, such that the main body is kept in a swinging state, and the sprinkler head allows to adjust the outflow angle in tune with the varying rotation or shift angle of the swaying portion; of which, the angle division and locating frame is linked to the rear end of the rotating seat of the main body, while the locating portion is linked to the rear end of the permanent seat of the assembly portion, and a punch hole is set for transverse insertion and locating of the driving rod.

3. The structure defined in claim 2, wherein the rotating seat is provided with a shaft lever and a circumferential flow channel, and the permanent seat is provided with a shaft hole for the shaft lever, allowing for fixation via bolt; the permanent seat is also provided with a water inlet.

4. The structure defined in claim 1, wherein said swaying portion formed between the sprinkler head and assembly portion comprises of a rotating seat and two locating bulges set on both sides of the assembly portion; said sprinkler head is set onto the rotating seat, which is provided with a locating portion; the locating portion of the rotating seat is locked onto the locating bulge to enable free swinging of the sprinkler head; of which the angle division and locating frame is linked to the rear end at one side of the rotating seat, while the locating portion is linked correspondingly to the main body, and a punch hole is set for transverse insertion and locating of the driving rod.

5. The structure defined in claim 1, wherein the arched surface of the angle division and locating frame has an arched pattern; moreover, the angle division and locating frame is provided with a hollow portion, which is located correspondingly to the arched surface, such that the tooth flange is formed internally onto the arched surface.

6. The structure defined in claim 1, wherein the tooth flanged portion of the driving rod is set annularly onto one end of the driving rod.

* * * * *